US006088010A

United States Patent [19]

Makino et al.

[11] Patent Number: 6,088,010

[45] Date of Patent: Jul. 11, 2000

[54] COLOR PLASMA DISPLAY PANEL AND METHOD OF DRIVING THE SAME

[75] Inventors: Mitsuyoshi Makino; Toshihiro Yoshioka, both of Tokyo, Japan

[73] Assignee: NEC Corporation, Tokyo, Japan

[21] Appl. No.: 08/954,099

[22] Filed: Oct. 20, 1997

[30] Foreign Application Priority Data

Oct. 21, 1996 [JP] Japan ..... 8-278197

[51] Int. Cl.[7] ..... G09G 3/28

[52] U.S. Cl. ..... 345/60; 345/55

[58] Field of Search ..... 345/60, 63, 68, 345/88, 149, 152, 41, 42, 61, 62; 315/169.1, 169.2, 169.3, 169.4; 313/582, 583, 584, 585, 586, 587

[56] References Cited

U.S. PATENT DOCUMENTS

| | | | |
|---|---|---|---|
| 4,600,274 | 7/1986 | Morozumi | 350/339 F |
| 4,801,933 | 1/1989 | Yamamoto et al. | 340/784 |
| 5,107,182 | 4/1992 | Sano et al. | 315/169.4 |
| 5,763,139 | 4/1992 | Matsunaga et al. | 430/313 |
| 5,835,072 | 11/1998 | Kanazawa | 345/60 |

FOREIGN PATENT DOCUMENTS

| | | |
|---|---|---|
| 2-66593 | 3/1990 | Japan . |
| 4-248588 | 9/1992 | Japan . |

OTHER PUBLICATIONS

T. Nakamura et al., "Drive for 40–in.–Diagonal Full–Color ac Plasma Display", *SID 95 Digest*, pp. 807–810.

*Primary Examiner*—Lun-Yi Lao
*Assistant Examiner*—Jimmy Hai Nguyen
*Attorney, Agent, or Firm*—Sughrue, Mion, Zinn, Macpeak & Seas, PLLC

[57] ABSTRACT

An AC-discharge color plasma display panel has a matrix of unit discharge spaces which include unit discharge spaces for emitting light in the same color that are arranged along the scan electrodes, and sets of three adjacent unit discharge spaces for emitting light in three different colors that are arranged along the data electrode. Scan pulses and data pulses applied to the unit discharge spaces to generate writing discharges according to display information and pairs of sustaining pulses applied to the unit discharge spaces to generate and maintain sustaining discharges are controllable with respect to pulse durations, oscillation frequencies, voltages, etc. for each of the colors. A method of driving the AC-discharge color plasma display panel is also disclosed.

12 Claims, 7 Drawing Sheets

COLOR PLASMA DISPLAY PANEL AND METHOD OF DRIVING THE SAME

BACKGROUND OF THE INVENTION

1. Field of the Invention

The present invention relates to a plasma display panel and a method of driving such a plasma display panel, and more particularly to a three-electrode AC-discharge color plasma display panel and a method of driving such a three-electrode AC-discharge color plasma display panel.

2. Description of the Prior Art

Plasma display panels for use as wide-area flat display units for personal computers, work stations, and wall-hanging television sets are roughly classified according to operating principles into DC-discharge plasma display panels in which electrodes are exposed to a discharge gas and discharge only while a voltage is being applied to the electrodes, and AC-discharge plasma display panels in which electrodes are covered with a dielectric layer and discharge while they are not exposed to a discharge gas. In the AC-discharge plasma display panels, discharge cells themselves have a memory function imparted by the charge storage action of the dielectric layer.

One general three-electrode AC-discharge plasma display panel (hereinafter also referred to as an "AC-PDP" or "PDP") will be described below with reference to FIG. 1 which shows the PDP in cross section.

As shown in FIG. 1, the PDP comprises a face plate 10 made of glass, back plate 11 made of glass, scan electrodes 12 and common electrodes 13 which are disposed parallel to each other on face plate 10, dielectric layer 15*a* covering scan electrodes 12 and common electrodes 13, protective layer 16 made of MgO or the like for protecting dielectric layer 15*a* from discharges, data electrodes 19 disposed on back plate 11 perpendicularly to scan electrodes 12 and common electrodes 13, dielectric layer 15*b* covering data electrodes 19, phosphor 18 coated on dielectric layer 15*b* for converting an ultraviolet radiation generated upon discharges into visible light for color display, and partitions 17 extending between phosphor 18 and protective layer 16 to define a discharge space therebetween and dividing the discharge space into unit discharge spaces 20. A mixture gas of He, Ne, Xe, etc. is sealed as a discharge gas in the discharge space. The areas of unit discharge spaces 20 are colored by phosphor 12 with red (R), green (G), and blue (B) to make it possible for the PDP to display color images.

A writing discharge, which determines whether or not each of the unit discharge spaces 20 emits light, is a discharge (called "opposing discharge") across an opposing discharge gap between dielectric layer 15*a* and dielectric layer 15*b* along the height of partitions 17 (with the thicknesses of protective layer 16 and phosphor 18 being ignored), and a sustaining discharge, which determines a quantity of light to be emitted, is a discharge (called "surface discharge") across a surface discharge gap in the unit discharge space.

FIG. 2 shows in plan a planar matrix of the three types of electrodes, i.e., scan electrodes 12, common electrodes 13, and data electrodes 19, and the unit discharge spaces of the color PDP shown in FIG. 1. FIG. 2 also illustrates a driver system for those electrodes.

As shown in FIG. 2, frames surrounding the reference characters R, G, B represent the respective unit discharge spaces that are surrounded by the partitions. The reference characters R, G, B indicate colors of emissions that are caused by discharges in the unit discharge spaces. Three adjacent ones of the unit discharge spaces R, G, B display a desired color by combining the three colors which are generated thereby. Such three adjacent unit discharge spaces R, G, B are collectively referred to as a "picture element", and each of the unit discharge spaces as a "pixel". Therefore, FIG. 2 shows a matrix of these pixels on the display screen of the color PDP, and the scanning, common, and data electrodes for applying scanning, data, and sustaining pulses to the pixels.

Scan electrodes 12 and common electrodes 13 extend parallel to each other horizontally across the display screen, and data electrodes 19 extend parallel to each other vertically in perpendicular relation to scan electrodes 12 and common electrodes 13. Three adjacent pixels R, G, B, which jointly make up a picture element, are arranged along each of scan electrodes 12. Scan electrodes 12 are separately connected to scan driver 4, and data electrodes 19 are separately connected to data driver 5. Common electrodes 13 are commonly connected to sustain driver 1 (sustain driver for common electrodes). Second sustain driver 2 (sustain driver for scan electrodes) is connected through scan driver 4 to scan electrodes 12. Sustain driver 1 and second sustain driver 2 are connected to control driver 3 which produces a control signal for determining at least the oscillation frequency of sustaining pulses.

When the pixels or the unit discharge spaces are scanned by scan pulses applied from the scan electrodes 12 and data pulses are applied from data electrodes 19 in synchronism with the scan pulses, writing discharges, which are opposing discharges, are generated in the unit discharge spaces depending on display information that are given by the data pulses. Then a potential difference due to a wall charge (described later on) created by the writing discharges is added to the voltage of sustaining pulses thereby causing a sustaining discharge, which is a surface discharge, between scan electrodes 12 and common electrodes 13.

A process of driving the PDP will be described below with reference to FIG. 3 which shows the waveform and time sequence of drive voltages applied to the electrodes in one subfield. First, erase pulses 21 are applied to scan electrodes 12 to turn off those pixels which have emitted light in a preceding subfield, thereby turning off all the pixels. Then, priming discharge pulse 22 is applied to common electrodes 13 to discharge all the pixels to emit light compulsorily, after which priming erase pulses 23 are applied to scan electrodes 12 to turn off the priming discharges of all the pixels. The priming discharges make subsequent writing discharges easy.

After the priming discharges are turned off, scan pulses 24 are applied in a time-division fashion to the respective scan electrodes 12, and, in synchronism with scan pulses 24, data pulses 27 are applied to data electrodes 19 depending on whether there is lighting data of each pixel or not. Writing discharges occur in those pixels where data pulses 27 are applied when scan pulses 24 are applied. However, no writing discharges occur in those pixels where no data pulses 27 are applied when scan pulses 24 are applied. Diagonal lines at the data pulses 27 indicate that the presence or absence of data pulses 27 is determined depending on whether there is lighting data or not. It is assumed that scan pulses 24 are of negative polarity, data pulses 27 are of positive polarity, and sustaining pulses 25, 26 are of negative polarity.

In pixels where writing discharges occur, a positive charge called a wall charge is stored in dielectric layer 15*a* on scan electrode 12, and a first sustaining discharge is generated due to the sum of a positive potential owing to the wall charge and a voltage of first sustaining pulse 25 applied to common electrode 13. If the voltages of sustaining pulses 25 and 26 are adjusted in advance such that no discharges will be generated by any of the voltages of the sustaining pulses, the first and the subsequent sustaining discharges can not be generated in pixels where no writing discharges occur, since there is no potential due to a wall charge before first sustaining pulse 25 is applied. When the first sustaining discharge is generated, positive wall charges are stored in dielectric layer 15*a* on common electrodes 13, and negative wall charges are stored in dielectric layer 15*a* on scan electrodes 12. The potential difference due to the wall charges is added to sustaining pulses 26 applied to scan electrodes 12, and a second sustaining discharge occurs. A potential difference due to the wall charges produced by an xth sustaining discharge and a voltage of (x+1)th sustaining pulse are added to generate an (x+1)th sustaining discharge. After writing discharges are generated, sustaining pulses 25, 26 are applied alternately to scan electrodes 12 and common electrodes 13 to maintain sustaining discharges. The quantity of emitted light is determined by the number of times that sustaining discharges are maintained.

FIG. 4(*a*) shows a picture element which is a collection of three pixels R, G, B arranged along a scan electrode in the PDP shown in FIG. 2, and FIG. 4(*b*) shows scanning pulse 24 and data pulses 27 which are applied to generate writing discharges in pixels R, B, except pixel G. A process of selective display in each of the pixels will be described below with reference to FIGS. 4(*a*) and 4(*b*). Pixel G in FIG. 4(*a*) is shown hatched to indicate that pixel G is not emitting light.

Since scan electrode 12 extends across three pixels R, G, B that jointly make up one picture element, scan pulse 24 is applied simultaneously to these three pixels R, G, B. When scan pulse 24 is applied, data pulses 27 are applied respectively to data electrodes 19*a*, 19*c* of pixels R, B, and no data pulse is applied to data electrode 19*b* of pixel G. Writing discharges occur and shift to sustaining discharges in pixels R, B, and a writing discharge does not occur and does not shift to a sustaining discharge in pixel G. Therefore, whether three pixels R, G, B that jointly make up one picture element are to be energized to emit light or not is selected during one scan pulse. Stated otherwise, a scan pulse applied to the pixels that emit different colors is supplied from the same scan electrode.

Similarly, the respective sustaining pulses from scan electrodes 12 and common electrode 13 are applied simultaneously to pixels that emit different colors.

As explained above, in the matrix of pixels and electrodes shown in FIG. 2, because a scan electrode and a common electrode are shared by three pixels that jointly make up a picture element, i.e., three unit discharge spaces, the same sustaining pulse is applied to the pixels that emit different colors.

When the number of sustaining pulses for determining the quantity of emitted light is the same among pixels R, G, B, if the quantity of light emitted from pixel B is smaller than the quantity of light emitted from pixels R, G due to the characteristics of their phosphors, then a white image displayed by these pixels tends to be yellowish. Such a drawback may be avoided by using a correction circuit for increasing the level of a display luminance signal supplied to the pixel B. However, the correction circuit would make invalid a low-bit display luminance signal supplied to pixel B, reducing the number of gray levels that can be represented by pixel B. Furthermore, after the correction circuit is adjusted, it would be difficult to change the corrective quantity thereof, i.e., to adjust the color balance.

Moreover, since the same scan pulse is applied to the pixels that emit different colors, it is difficult to cause appropriate writing discharges all over the display screen. Pixels R, G, B have different conditions to be met for causing appropriate writing discharges because of different charging characteristics of the phosphors of pixels R, G, B. For example, when it is more difficult for pixels G to cause appropriate writing discharges and it is easier for pixels B to cause appropriate writing discharges, if scanning pulses to be applied to a scan electrode are established with their voltage and width selected for pixels G to be able to cause appropriate writing discharges, then pixels B on the same scan electrode may possibly cause writing discharges in error.

SUMMARY OF THE INVENTION

It is therefore an object of the present invention to provide an AC-discharge color plasma display panel (AC-PDP) which is capable of adjusting scanning and sustaining pulses applied to pixels for emitting different colors respectively with respect to the colors emitted by the pixels, so that the AC-PDP can display high-quality color images all over a display screen thereof.

To achieve the above object, there is provided a color plasma display panel comprising:

scan electrodes and data electrodes both extending substantially straight and in perpendicular relation to each other;

a matrix of unit discharge spaces in which unit discharge spaces for emitting light in the same color are arranged along the scan electrodes so that the same scan pulses may be applied from the same scan electrodes, and the sets of three adjacent unit discharge spaces for emitting light in the colors of red, green, and blue are arranged along the data electrodes so that the same data pulses may be applied from the same data electrodes; and pairs of sustaining discharge electrodes which apply pairs of sustaining pulses for generating sustaining discharges and maintaining the sustaining discharges for a predetermined period of time in the unit discharge spaces, in which the writing discharges have just been generated by the scan pulses applied from the scan electrodes and the data pulses applied from the data electrodes in synchronism with the scan pulses, depending on lighting information.

The pairs of sustaining discharge electrodes may comprise the scan electrodes and third electrodes disposed closely to the scan electrodes other than the data electrodes in the same unit discharge spaces.

According to another aspect of this invention, there is provided a method of driving a color plasma display panel comprising:

controlling writing discharges in the unit discharge spaces to emit light in colors of red, green, or blue with scan pulses applied from scan electrodes and data pulses applied from data electrodes in synchronism with the scanning pulses depending on lighting information;

generating sustaining discharges with sustaining discharge pulses applied alternately from pairs of sustaining discharge electrodes in the unit discharge spaces in which the writing discharges have just been generated, and maintaining the sustaining discharges for a predetermined period of time; wherein one or both of writing discharges or sustaining discharges is controlled independently in the unit discharge spaces for emitting different colors.

The above and other objects, features, and advantages of the present invention will become apparent from the following description with references to the accompanying drawings which illustrate examples of the present invention.

BRIEF DESCRIPTION OF THE DRAWINGS

FIG. 4(*b*) is a diagram showing a driving timing of scan pulse and data pulses applied to the pixels shown in FIG. 4(*a*);

FIG. 5(*b*) is a diagram showing a driving timing of scan pulses and data pulses applied to the pixels shown in FIG. 5(*a*);

DETAILED DESCRIPTION OF THE PREFERRED EMBODIMENTS

Figure 1:
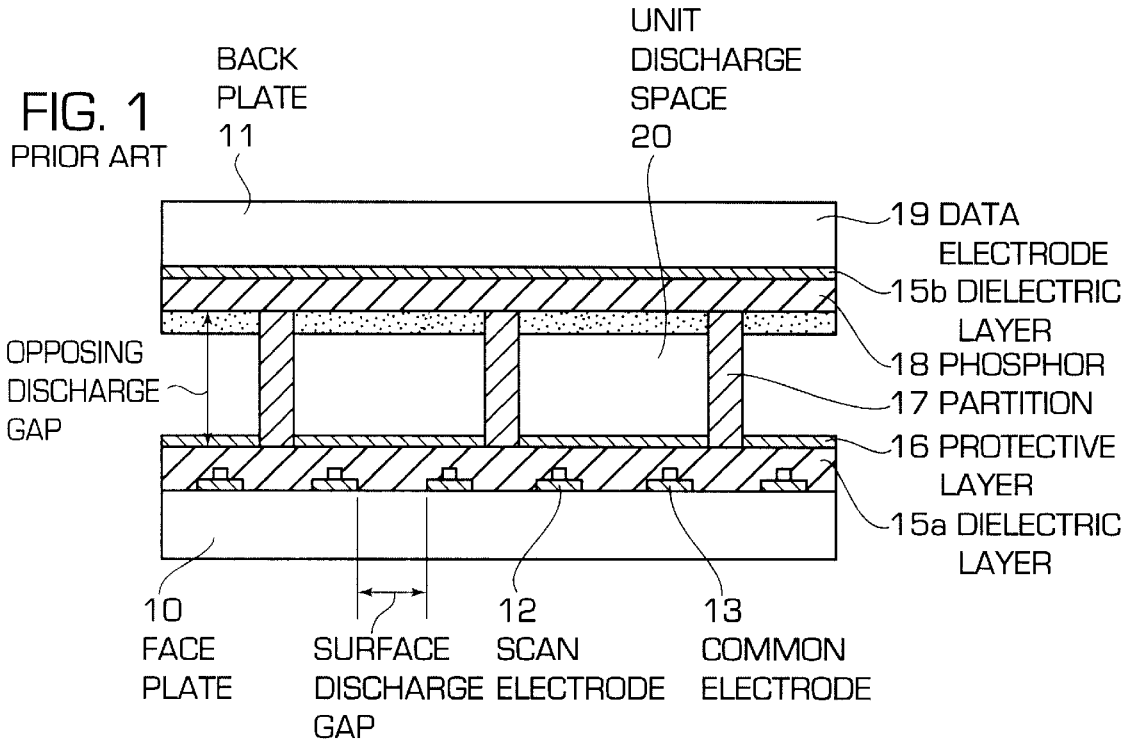
FIG. 1 PRIOR ART
FIG. 1 is a fragmentary cross-sectional view of a conventional AC-PDP.
Figure 2:
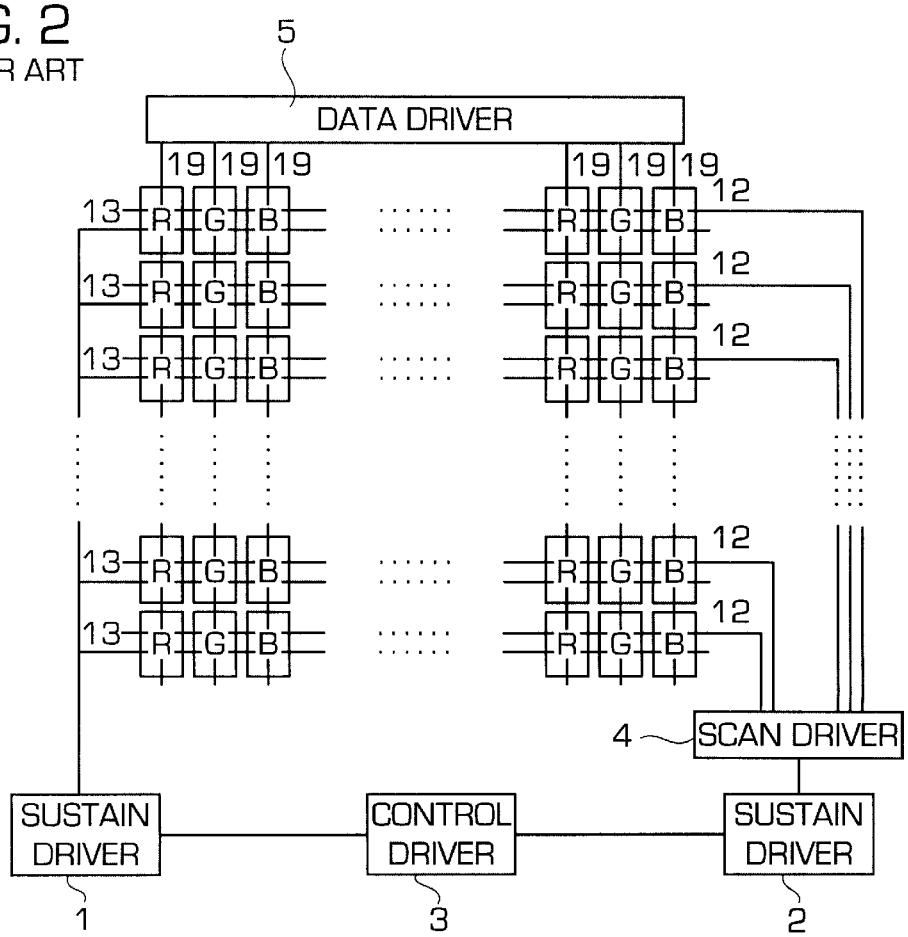
FIG. 2 PRIOR ART
FIG. 2 is a block diagram of pixels, electrodes, and drivers of the conventional AC-PDP shown in FIG. 1.
Figure 3:
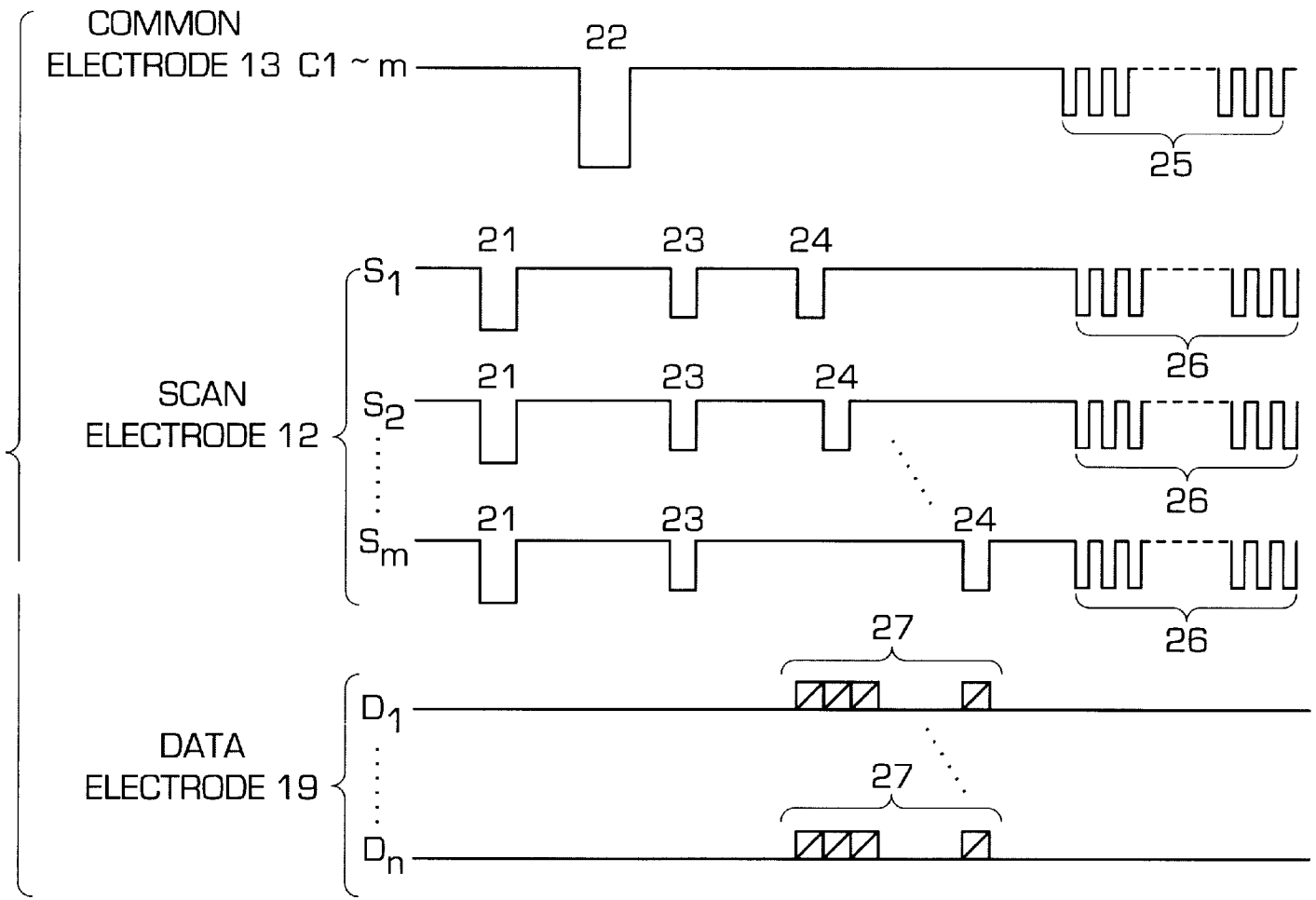
FIG. 3 PRIOR ART
FIG. 3 is a diagram showing the waveform and time sequence of driving pulses applied to the electrodes of the conventional AC-PDP in one subfield.
Figure 4A:
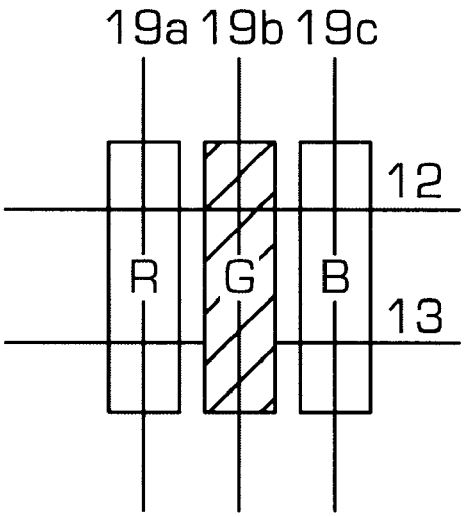
FIG. 4(a) PRIOR ART
FIG. 4(*a*) is a diagram showing three pixels that jointly make up a picture element and electrodes for driving these pixels in the conventional AC-PDP.
Figure 4B:
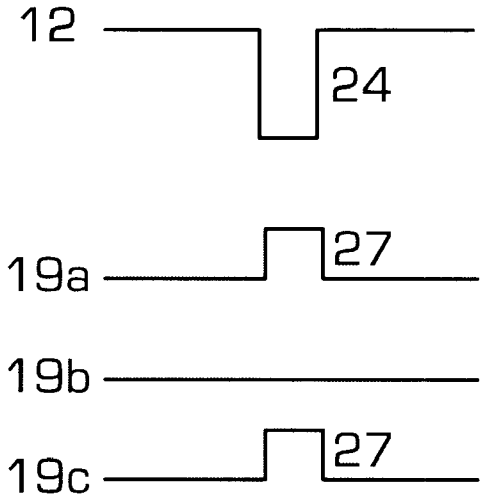
FIG. 4(b) PRIOR ART
Figure 5A:
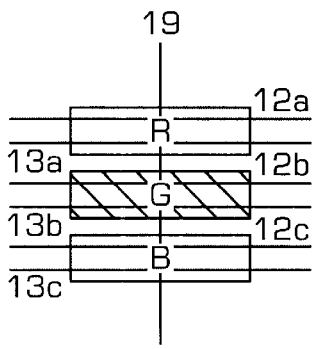
FIG. 5(*a*) is a diagram showing three pixels that jointly make up a picture element and electrodes for driving these pixels in an AC-PDP according to the present invention.
Figure 5B:
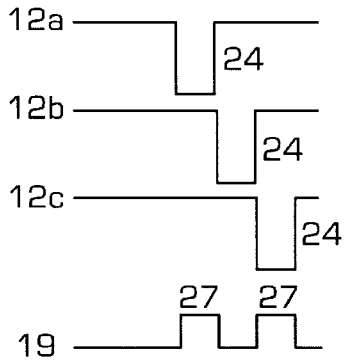

FIG. 5(*a*) shows a picture element which is a collection of three pixels R, G, B, scan electrodes 12*a*, 12*b*, 12*c*, common electrodes 13*a*, 13*b*, 13*c*, and a data electrode 19, and FIG. 5(*b*) shows scan pulses 24 and data pulses 27 which are applied to generate writing discharges in pixels R, B, except the pixel G. Pixel G in FIG. 5(*a*) is shown hatched to indicate that pixel G is not emitting light.

Pixels R, G, B which jointly make up a picture element are arranged along data electrode 19, which is thus shared by the pixels R, G, B. Scanning and common electrodes 12*a*, 13*a* extend through pixel R, scan and common electrodes 12*b*, 13*b* extend through pixel G, and scan and common electrodes 12*c*, 13*c* extend through pixel B.

Pixels R, G, B are selected for emitting light and not emitting light as follows: In order to select pixels R, B for emitting light and pixel G for not emitting light, data pulse 27 is applied to data electrode 19 when scan pulse 24 is applied to scan electrode 12*a* that extends through pixel R, data pulse 27 is applied to data electrode 19 when scan pulse 24 is applied to scan electrode 12*c* that extends through pixel B, and no data pulse 27 is applied to data electrode 19 when scan pulse 24 is applied to scan electrode 12*b* that extends through pixel G. Therefore, writing discharges occur and shift to sustaining discharges in pixels R, B, but a writing discharge does not occur and does not shift to a sustaining discharge in pixel G. Consequently, pixels R, G, B which make up a picture element are selected for emitting light and not emitting light with three scan pulses.

Figure 6:
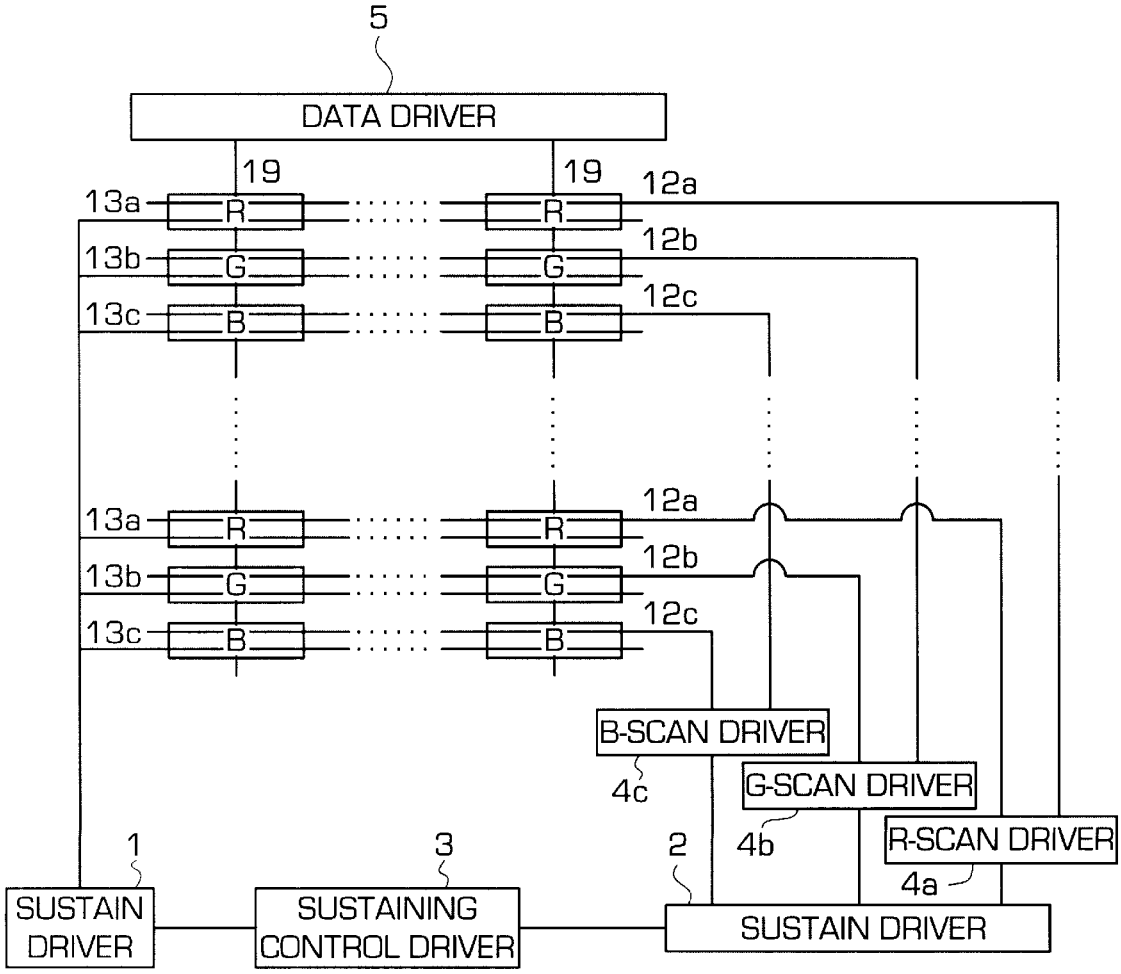
FIG. 6 is a block diagram of pixels, electrodes, and drivers of an AC-PDP according to a first embodiment of the present invention.

FIG. 6 shows in block form pixels, electrodes, and drivers of an AC-PDP according to a first embodiment of the present invention, the pixels and the electrodes jointly making up a display panel structure. As shown in FIG. 6, pixels R, G, B are arranged along data electrodes 19, and those pixels which emit the same colors are arranged along the same scan electrodes. Stated otherwise, unit discharge spaces coated with a phosphor for emitting the same color are arranged along the same scan electrodes. A plurality of scan electrodes for applying scan pulses to those pixels which emit the same color are grouped together, and different groups of scan electrodes 12*a*, 12*b*, 12*c* are connected respectively to R-, G-, B-scan drivers 4*a*, 4*b*, 4*c* for the respective colors to be emitted. Data electrodes 19 are separately connected to data driver 5. Common electrodes 13*a*, 13*b*, 13*c* are commonly connected to sustain driver 1. Second sustain driver 2 is connected through scan drivers 4*a*, 4*b*, 4*c* to scan electrodes 12*a*, 12*b*, 12*c*. Sustain driver 1 and second sustain driver 2 are connected to a sustaining control driver 3.

R-, G-, B-scan drivers 4*a*, 4*b*, 4*c* are capable of independently varying pulse durations, output voltages, and output timing of scan pulses which are to be applied thereby. Therefore, even if the phosphors used have different optimum writing pulse conditions due to their different electric characteristics, appropriate writing discharges can be caused in all the pixels by independently adjusting output conditions of the scan drivers.

Figure 7:
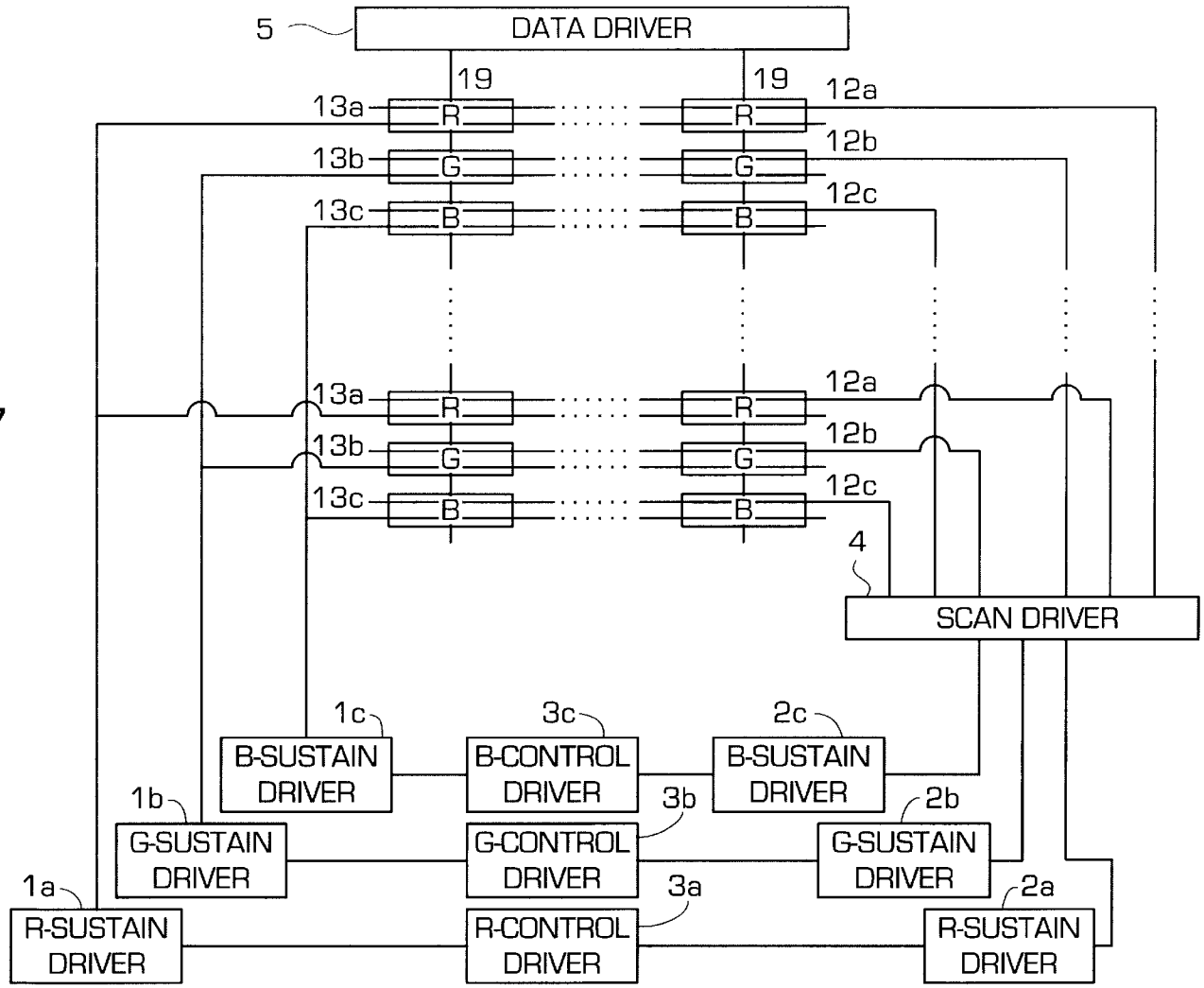
FIG. 7 is a block diagram of pixels, electrodes, and drivers of an AC-PDP according to a second embodiment of the present invention.

FIG. 7 shows in block form pixels, electrodes, and drivers of an AC-PDP according to a second embodiment of the present invention. The panel structure, which is made up of the pixels and the electrodes, of the AC-PDP shown in FIG. 7 is identical to the panel structure shown in FIG. 6.

In FIG. 7, a plurality of scan electrodes for applying scan pulses and sustaining pulses to those pixels which emit the same color, and a plurality of common electrodes corresponding to those scan electrodes are grouped together respectively. The groups of scan electrodes are connected to a scanning driver 4, and different groups of scan and common electrodes are connected respectively to pairs of R-, G-, B-sustain drivers 1*a*, 2*a*; 1*b*, 2*b*; 1*c*, 2*c* for the respective colors to be emitted.

The pairs of R-, G-, B-sustain drivers 1*a*, 2*a*; 1*b*, 2*b*; 1*c*, 2*c* are connected respectively to R-, G-, B-control drivers 3*a*, 3*b*, 3*c* which can control one or more of pulse durations, oscillation frequencies, output voltages, or output timing of sustaining pulses to be applied to the scan and common electrodes.

If the luminance of pixels B is smaller than the luminance of pixels R, G with the same sustaining pulse settings, then the B-control driver 3*c* can be adjusted to have the output settings different from the output settings of R-, and G-control drivers 3*a*, 3*b*. For example, the oscillation frequency of the sustaining pulses for pixels B is increased to increase the number of times that pixels B emit light per unit time, or the output voltage of the sustaining pulses for pixels B is increased to increase the intensity of the light emitted by pixels B per discharge, for thereby increasing only the luminance of pixels B to achieve a desired color balance.

Similarly, if the luminance of pixels G is greater than the luminance of pixels R, B with the same sustaining pulse settings, then G-control driver 3*b* is adjusted to have the output settings different from the output settings of R-, and B-control drivers 3*a,* 3*c*.For example, the oscillation frequency of the sustaining pulses for pixels G is decreased to decrease the number of times that pixels G emit light per unit time, or the output voltage of the sustaining pulses for pixels G is decreased to decrease the intensity of the light emitted by pixels G per discharge, for thereby decreasing only the luminance of pixels G to achieve a desired color balance.

Figure 8:
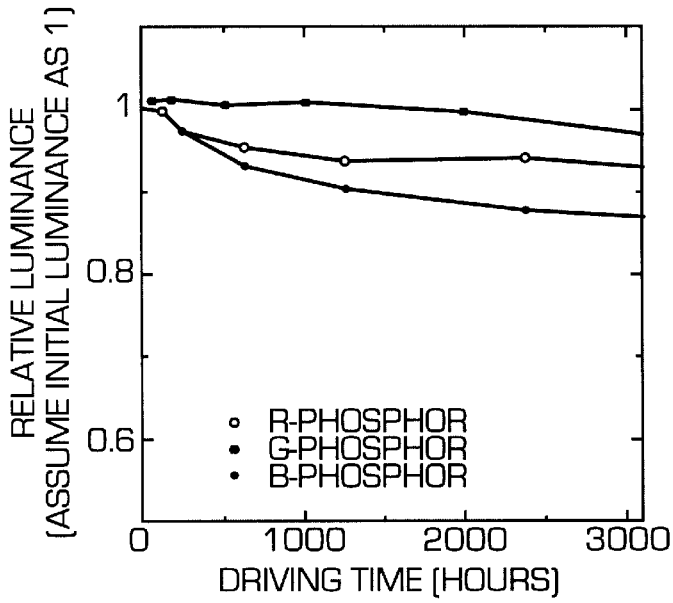
FIG. 8 is a diagram showing the relationship between energization times and emission luminances of R, G, B phosphor materials.

Because the sustaining pulse conditions can be varied with respect to each of pixels R, G, B, the color balance can easily be corrected after the AC-discharge color plasma display panel has been energized for a long time. FIG. 8 shows how the luminances of the phosphors of pixels R, G, B vary with time when they are continuously energized at the same drive frequency. As shown in FIG. 8, the luminance of the phosphor of pixel B becomes lower with time than the luminances of the phosphors of pixels R, G. Even if the AC-PDP is adjusted for a desired color balance immediately after it is assembled, the color balance will thus be changed after it is energized for a long time due to different luminance vs. energization time characteristics of the phosphors of pixels R, G, B. This drawback can be overcome by adjusting the output settings of R-, G-, B-control drivers 3*a,* 3*b,* 3*c* to achieve the desired color balance again. The color balance can be adjusted with utmost ease if the output settings of R-, G-, B-control drivers 3*a,* 3*b,* 3*c* are made adjustable with variable resistors.

Figure 9:
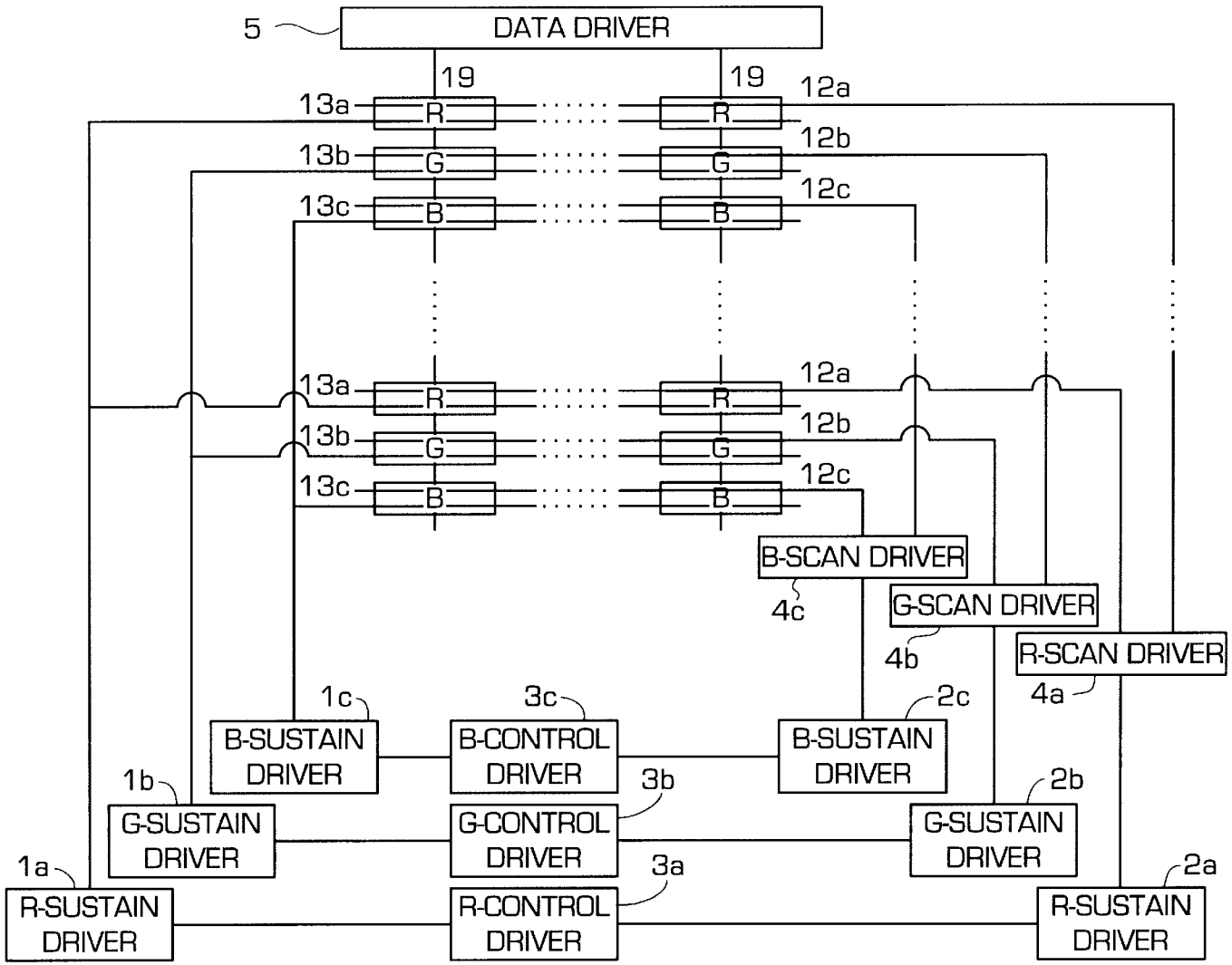
FIG. 9 is a block diagram of pixels, electrodes, and drivers of an AC-PDP according to a third embodiment of the present invention.

FIG. 9 shows in block form pixels, electrodes, and drivers of an AC-PDP according to a third embodiment of the present invention. The panel structure, which is made up of the pixels and the electrodes is identical to the panel structure shown in FIG. 6 or 7.

In FIG. 9, a plurality of scan electrodes 12 for applying scan pulses to those pixels which emit the same color, and a plurality of common electrodes 13 corresponding to those scan electrodes are grouped together respectively. Different groups of scan electrodes 12*a,* 12*b,* 12*c* are connected respectively to R-, G-, B-scan drivers 4*a,* 4*b,* 4*c* for the respective colors to be emitted, and different groups of scan and common electrodes are connected respectively to pairs of R-, G-, B-sustain drivers 1*a,* 2*a;* 1*b,* 2*b;* 1*c,* 2*c* for the respective colors to be emitted, R-, G-, B-scanning drivers 4*a,* 4*b,* 4*c* being connected respectively to R-, G-, B-sustain drivers 2*a,* 2*b,* 2*c*.

The pairs of R-, G-, B-sustain drivers 1*a,* 2*a;* 1*b,* 2*b;* 1*c,* 2*c* are connected respectively to R-, G-, B-sustaining control drivers 3*a,* 3*b,* 3*c* which can control one or more of pulse durations, oscillation frequencies, output voltages, or output timing of sustaining pulses to be applied to the scan and common electrodes.

The AC-PDP shown in FIG. 9 offers the advantages of both the AC-PDP shown in FIGS. 6 and 7, in that it is capable of causing appropriate writing discharges in the pixels depending on the difference between writing characteristics of the pixels due to different characteristics of the phosphors thereof, and also of easily adjusting the color balance.

Figure 10:
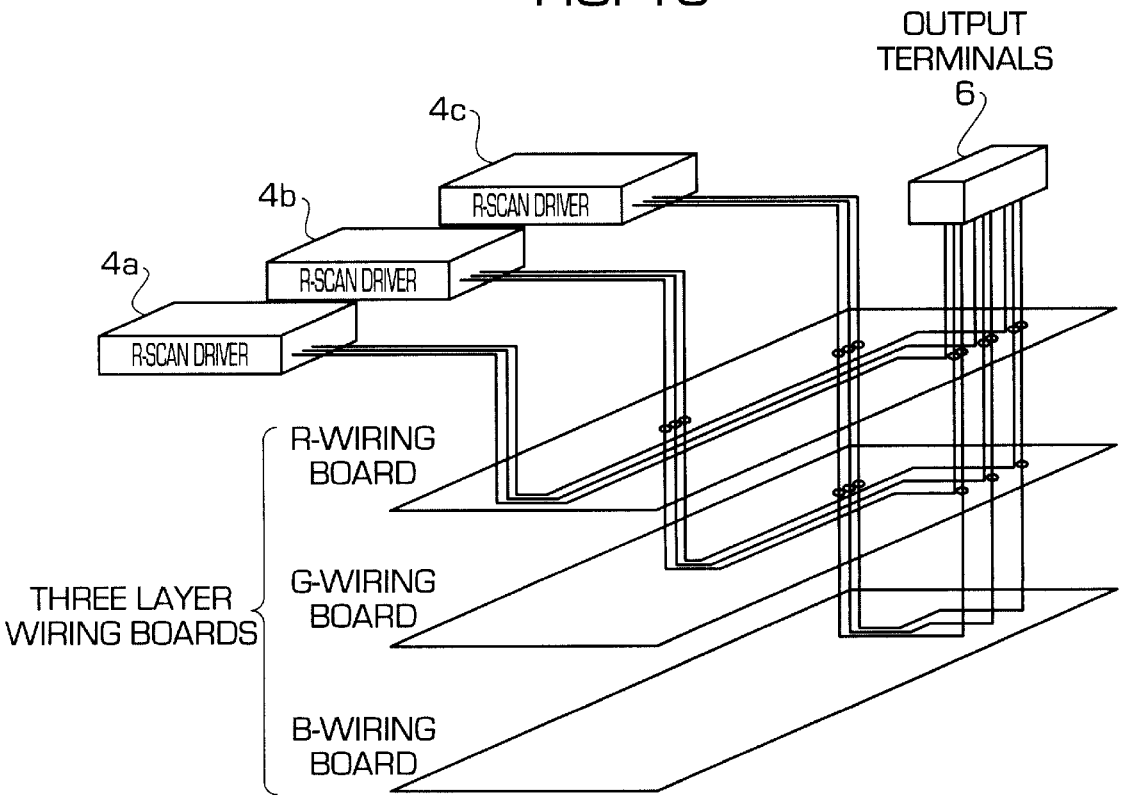
FIG. 10 is a schematic perspective view of a three-dimensional multi-layer wiring board assembly that can be used with the AC-PDP according to the first through third embodiments.

FIG. 10 shows a three-dimensional multi-layer wiring board assembly that can be used with the AC-PDP according to the first through third embodiments of the present invention. In FIG. 10, the three-dimensional multi-layer wiring board assembly has three sets of output signal lines or pulse signal lines that are connected to respective R-, G-, B-scanning drivers 4*a,* 4*b,* 4*c* for applying drive pulses to pixels for emitting respective colors. The three sets of pulse signal lines are disposed on respective vertically spaced boards in order to avoid a superposed crossing arrangement on one board of the pulse signal lines. The pulse signal lines on the boards are connected to output terminals 6 that are connected to scan electrodes of the AC-PDP.

Specifically, the scan pulse signal lines extend from R-, G-, B-scan drivers 4*a,* 4*b,* 4*c* to the boards, and then extend from the boards to output terminals 6 where the scan pulse signal lines are re-arranged in the same sequence as the scan electrodes of the display panel. More specifically, the scan pulse signal lines from R-scan driver 4*a,* the scan pulse signal lines from G-scan driver 4*b,* and the scan pulse signal lines from B-scan driver 4*c* are disposed on the respective boards, and are connected to the output terminals 6 and rearranged in the sequence which corresponds to the sequence of the scan electrodes of the display panel.

If separate R-, G-, B-sustain drivers are employed, then output signal lines from R-, G-, B-sustain drivers 2*a,* 2*b,* 2*c* for applying sustaining pulses to the scan electrodes 12*a,* 12*c,* 12*c* and output signal lines from R-, G-, B-sustain drivers 1*a,* 1*b,* 1*c* for applying sustaining pulses to the common electrodes 13*a,* 13*b,* 13*c* are disposed on the respective boards, and are connected to the output terminals 6 and rearranged in the sequence which corresponds to the sequence of the scan electrodes and common electrodes of the display panel.

Specifically, output signal lines from R-sustain driver 2*a,* output signal lines from G-sustain driver 2*b,* and output signal lines from R-sustain driver 2*c* are disposed on the respective boards, and are connected to the output terminals 6 and re-arranged in the sequence which corresponds to the sequence of the scan electrodes of the display panel. Likewise, output signal lines from R-sustain driver 1*a,* output signal lines from G-sustain driver 1*b,* and output signal lines from R-sustain driver 1*c* are disposed on the respective boards, and are connected to output terminals 6 and re-arranged in the sequence which corresponds to the sequence of the common electrodes of the display panel.

It is to be understood that variations and modifications of the color plasma display panel disclosed herein will be evident to those skilled in the art. It is intended that all such modifications and variations be included within the scope of the appended claims.

What is claimed is:

1. A color plasma display panel for displaying color images with combined colors produced by discharges generated in sets of three adjacent unit discharge spaces for emitting different colors, comprising:

a plurality of scan electrodes and a plurality of data electrodes both extending substantially straight and in perpendicular relation to each other;

a matrix of unit discharge spaces in which a plurality of unit discharge spaces for emitting light in the same color are arranged along said scan electrodes so that the same scan pulses may be applied from the same scan electrodes, and said sets of three adjacent unit discharge spaces for emitting light in colors of red, green, and blue are arranged in repeating sets along said data electrodes so that the same data pulses may be applied from the same data electrodes;

as many scan drivers, which generate the scan pulses, as a number of the colors, and one of said scan drivers being provided for each of the colors respectively; and pairs of sustaining discharge electrodes which apply pairs of sustaining pulses for generating sustaining discharges and maintaining said sustaining discharges for a predetermined period of time in the unit discharge spaces, in which writing discharges have just been generated by the scan pulses applied from the scan electrodes and the data pulses applied from the data electrodes in synchronism with said scan pulses, depending on lighting information.

2. A color plasma display panel according to claim 1, further comprising one data driver and one pair of sustaining discharge drivers, which generate data pulses and pairs of sustaining discharge pulses respectively, and said scan drivers, data driver, and sustaining discharge drivers apply said scan pulses, data pulses and pairs of sustaining pulses to the unit discharge spaces via the scan electrodes, data electrodes and pair of sustaining discharge electrodes respectively.

3. A color plasma display panel according to claim 2, wherein said pairs of sustaining discharge electrodes comprise said scan electrodes, and third electrodes disposed closely to said scan electrodes other than said data electrodes in the unit discharge spaces.

4. A color plasma display panel according to claim 2, wherein said scan pulses applied from the scan drivers are variable with respect to at least one of pulse durations, voltages, and output timing for each of the colors.

5. A color plasma display panel according to claim 2, further comprising as many pairs of sustain drivers as the number of the colors, one pair of sustain drivers provided for each of the colors respectively.

6. A color plasma display panel according to claim 5, wherein said sustaining discharge pulses applied from the sustain drivers are variable with respect at least one more of pulse durations, oscillation frequencies, voltages, and output timing for each of the colors.

7. A color plasma display panel according to claim 2, wherein output signal lines extending from said scan drivers to the input terminals of the scan electrodes for each of the colors are arranged without being held in a superposed crossing state on one board.

8. A color plasma display panel according to claim 7, wherein output signal lines extending from said sustain drivers to the input terminals of the sustaining discharge electrodes for each of the colors are arranged without being held in a superposed crossing state on one board.

9. A method of driving a color plasma display panel for displaying color images with combined colors produced by discharges generated in sets of three adjacent unit discharge spaces for emitting different colors, comprising the steps of:

controlling writing discharges in the unit discharge spaces to emit light in colors of red, green, or blue with scan pulses generated by scan drivers and applied from scan electrodes and data pulses applied from data electrodes in synchronism with said scan pulses depending on lighting information; wherein there are as many scan drivers as a number of the colors, one of said scan drivers being provided for each of the colors respectively generating sustaining discharges with sustaining discharge pulses applied alternately from pairs of sustaining discharge electrodes in the unit discharge spaces in which said writing discharges have just been generated, and maintaining said sustaining discharges for a predetermined period of time;

wherein at least one of said writing discharges and said sustaining discharges is controlled independently in the unit discharge spaces for emitting different colors.

10. A color plasma display panel for displaying color images with combined colors produced by discharges generated in sets of three adjacent unit discharge spaces for emitting different colors, comprising:

a plurality of scan electrodes and a plurality of data electrodes both extending substantially straight and in perpendicular relation to each other;

a matrix of unit discharge spaces in which a plurality of unit discharge spaces for emitting light in the same color are arranged along said scan electrodes so that the same scan pulses may be applied from the same scan electrodes, and said sets of three adjacent unit discharge spaces for emitting light in colors of red, green, and blue are arranged in repeating sets along said data electrodes so that the same data pulses may be applied from the same data electrodes;

pairs of sustaining discharge electrodes which apply pairs of sustaining pulses for generating sustaining discharges and maintaining said sustaining discharges for a predetermined period of time in the unit discharge spaces, in which writing discharges have just been generated by the scan pulses applied from the scan electrodes and the data pulses applied from the data electrodes in synchronism with said scan pulses, depending on lighting information;

at least one scan driver, one data driver and one pair of sustaining discharge drivers, which generate the scan pulses, data pulses and pairs of sustaining discharge pulses respectively, and apply said scan pulses, data pulses and pairs of sustaining pulses to the unit discharge spaces via the scan electrodes, data electrodes and pair of sustaining discharge electrodes respectively; and as many pairs of sustain drivers as the number of the colors, one pair of said sustain drivers provided for each of the colors respectively.

11. A color plasma display panel according to claim 10, wherein said sustaining discharge pulses applied from the sustain drivers are variable with respect to at least one of pulse durations, oscillation frequencies, voltages, and output timing for each of the colors.

12. A color plasma display panel according to claim 10, wherein output signal lines extending from said sustain drivers to the input terminals of the sustaining discharge electrodes for each of the colors are arranged without being held in a superposed crossing state on one board.

* * * * *

UNITED STATES PATENT AND TRADEMARK OFFICE

CERTIFICATE OF CORRECTION

PATENT NO. : 6,088,010
DATED : July 11, 2000
INVENTOR(S) : Mitsuyoshi MAKINO, YOSHIOKA, TOSHIHIRO It is certified that error appears in the above-identified patent and that said Letters Patent is hereby corrected as shown below:

Column 8, line 24, delete "12c" insert --12b--.

Column 9, line 34, after "respect" insert --to--.

line 34, delete "more".

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*